US005758363A

United States Patent [19]

Winfree

[11] Patent Number: 5,758,363

[45] Date of Patent: Jun. 2, 1998

[54] SPORT SHIRT OR OTHER GARMENT WITH LOAD-DISTRIBUTING SHOULDER YOKE

[76] Inventor: Gregory D. Winfree, 11 Cornell Rd., New Milford, Conn. 06776

[21] Appl. No.: 560,500

[22] Filed: Nov. 17, 1995

[51] Int. Cl.[6] ..... A41B 1/08

[52] U.S. Cl. ..... 2/122; 2/115; 2/108; 2/69

[58] Field of Search ..... 2/122, 121, 115, 2/69, 85, 93, 94, 108, 268, 267

[56] References Cited

U.S. PATENT DOCUMENTS

| | | | |
|---|---|---|---|
| 641,099 | 1/1900 | Elbaum . | |
| 1,489,080 | 3/1924 | Lee . | |
| 2,061,435 | 12/1936 | Neidecker . | |
| 2,502,201 | 12/1950 | Breier . | |
| 4,397,043 | 8/1983 | Croteau | 2/2 |
| 4,800,593 | 1/1989 | Ruffner | 2/94 |
| 5,388,271 | 2/1995 | Sessoms | 2/115 |

OTHER PUBLICATIONS

The Sears Wishbook Catalog, 1980, p. 83 Items 1–3.

The Sears Wishbook Catalog, 1980 p. 318, Quiltlined Shirts.

*Primary Examiner*—Gloria M. Hale

*Attorney, Agent, or Firm*—Roylance, Abrams, Berdo & Goodman

[57] ABSTRACT

A sport shirt or other garment is provided with a load-distributing shoulder yoke for relieving the strain resulting from carrying a golf bag or the like. The load-distributing yoke comprises an outer layer of fabric and an inner layer of filler material below the outer layer of fabric, with the filler material serving to cushion the shoulders and upper torso of the wearer against the weight of the golf bag strap. The filler material preferably comprises a breathable, low-density material for venting body heat and evaporating moisture. The load-distributing yoke may further comprise a bottom layer of fabric below the inner layer of filler material.

20 Claims, 3 Drawing Sheets

SPORT SHIRT OR OTHER GARMENT WITH LOAD-DISTRIBUTING SHOULDER YOKE

FIELD OF THE INVENTION

The present invention relates generally to an article of clothing, and is particularly concerned with a sport shirt that is provided with a load-distributing yoke to relieve the strain on the wearer's shoulders and back that results from carrying a golf bag or the like.

BACKGROUND OF THE INVENTION

The game of golf is a target game generally played out over a course of nine or eighteen holes of varying lengths. Laid out end-to-end on a championship golf course, these holes can often stretch for more than four miles. The object of the game is to sink a ball 1.62 inches in diameter into a hole 4 inches or so in diameter in as few strokes as possible. The ball is struck with any of a maximum of fourteen golf clubs that a golfer carries about in a fabric, leather or synthetic golf bag. The golf bag generally has one strap that the golfer places over either shoulder in order to transport the golf clubs.

Because golf clubs are largely constructed of metallic components, the weight of a fully loaded golf bag can often exceed thirty pounds. As one can imagine, carrying a fully loaded golf bag on one's back for the several miles comprising a round of golf can be rather tiring and can cause a strain on the shoulders and upper back. Therefore, there is a need to protect a golfer from the stress and strain of carrying a golf bag in order to encourage a golfer to take advantage of the health and aerobic benefits of walking.

Recognizing the health and other benefits of walking, the United States Golf Association has spearheaded a movement to encourage golfers to walk the golf course wherever and whenever possible. The movement has been triggered by a recognition that motorized golf carts may detrimentally affect the environment and ecosystems supported by golf courses, the national focus on the health benefits of walking, and reverence for the traditions of the game. The present invention seeks to capitalize on the positive aspects of walking the golf course while concomitantly minimizing its negative aspects.

Shirts exhibiting a shoulder yoke or reinforcement covering the upper portions of the shirt are known. Exemplary shirts of this type are disclosed in U.S. Pat. No. 641,090, to Elbaum, and in U.S. Pat. No. 1,489,080, to Lee. In both cases, however, the yoke or reinforcement is simply an additional layer of fabric (pleated in the case of the Lee patent) without any intervening padding or filler material for distributing the weight of a golf bag strap. Moreover, the reinforcement shown in the Lee patent is provided only on the front portion of the shirt (forward of the shoulder seams) and thus would not cushion the shoulders and upper back of the wearer against the weight of a golf bag strap.

Shirts utilizing some sort of shoulder pad for aesthetic purposes are also known. Exemplary shirts of this type are disclosed in U.S. Pat. No. 2,061,435, to Neidecker, and in U.S. Pat. No. 2,502,201, to Breier. However, the size and placement of the shoulder pads utilized in these shirts is such that they would be of little use when carrying a golf bag. Padded full-body protective suits are also known, as disclosed, for example, in U.S. Pat. No. 4,397,043, to Croteau, but garments of this type are too cumbersome and restrictive for use by golfers.

The prior art does not provide a load-distributing shirt that would enable a golfer to walk, carry a full golf bag for eighteen or more holes, and play with substantially unrestricted movement, while absorbing moisture and venting body heat. The present invention is directed to these shortcomings.

SUMMARY OF THE INVENTION

It is an object of the present invention to provide a load-distributing sport shirt or other garment for use by golfers and the like, that will enable a golfer to walk and carry a full golf bag for eighteen or more holes with a minimum of discomfort.

It is a further object of the invention to provide a load-distributing sport shirt or other garment that permits free, unrestricted movement and a full range of mobility during play.

It is a still further object of the invention to provide a load-distributing sport shirt or other garment that promotes the dissipation of heat and evaporation of perspiration by using the body's heat to push moisture to the outer layer through capillary action.

The foregoing objects are achieved by providing a sport shirt or other garment which comprises front and rear portions made of fabric or the like for covering the chest and back of the wearer, respectively, a neck opening for accommodating the neck of the wearer, a pair of sleeves for covering at least the upper portions of the wearer's arms, and a load-distributing yoke affixed to and covering the upper regions of the front and rear portions of the garment and the upper regions of the sleeves for distributing the weight of a golf bag strap across the shoulders and upper torso of the wearer. The load-distributing yoke comprises an outer layer made of fabric or the like and an inner layer of filler material below the outer layer, with the filler material serving to cushion the shoulders and upper torso of the wearer against the weight of the golf bag strap. The filler material preferably comprises a breathable, low-density material for venting body heat and evaporating moisture. The load-distributing yoke may further include a bottom layer of fabric or the like below the inner layer of filler material.

The present invention is also directed to a load-distributing yoke which can be attached to a sleeved sport shirt or other sleeved garment to relieve the strain resulting from carrying a golf bag or the like. The load-distributing yoke comprises an outer layer of fabric or the like and an inner layer of filler material below the outer layer, for cushioning the shoulders and upper torso of the wearer against the weight of a golf bag strap. The outer and inner layers are shaped and dimensioned to cover the upper front and rear portions of the garment, including upper portions of the sleeves of the garment. As noted previously, the filler material preferably comprises a breathable, low-density material for venting body heat and evaporating moisture. The load-distributing yoke may further comprise a bottom layer of fabric or the like below the inner layer of filler material.

Other objects, advantages and novel features of the present invention will become apparent from the detailed description which follows.

BRIEF DESCRIPTION OF THE DRAWINGS

Referring now to the drawings, which form a part of the original disclosure.

Throughout the drawings, like reference numerals will be understood to refer to like portions of the illustrated sport shirt.

DETAILED DESCRIPTION OF THE PREFERRED EMBODIMENT

Figure 1:
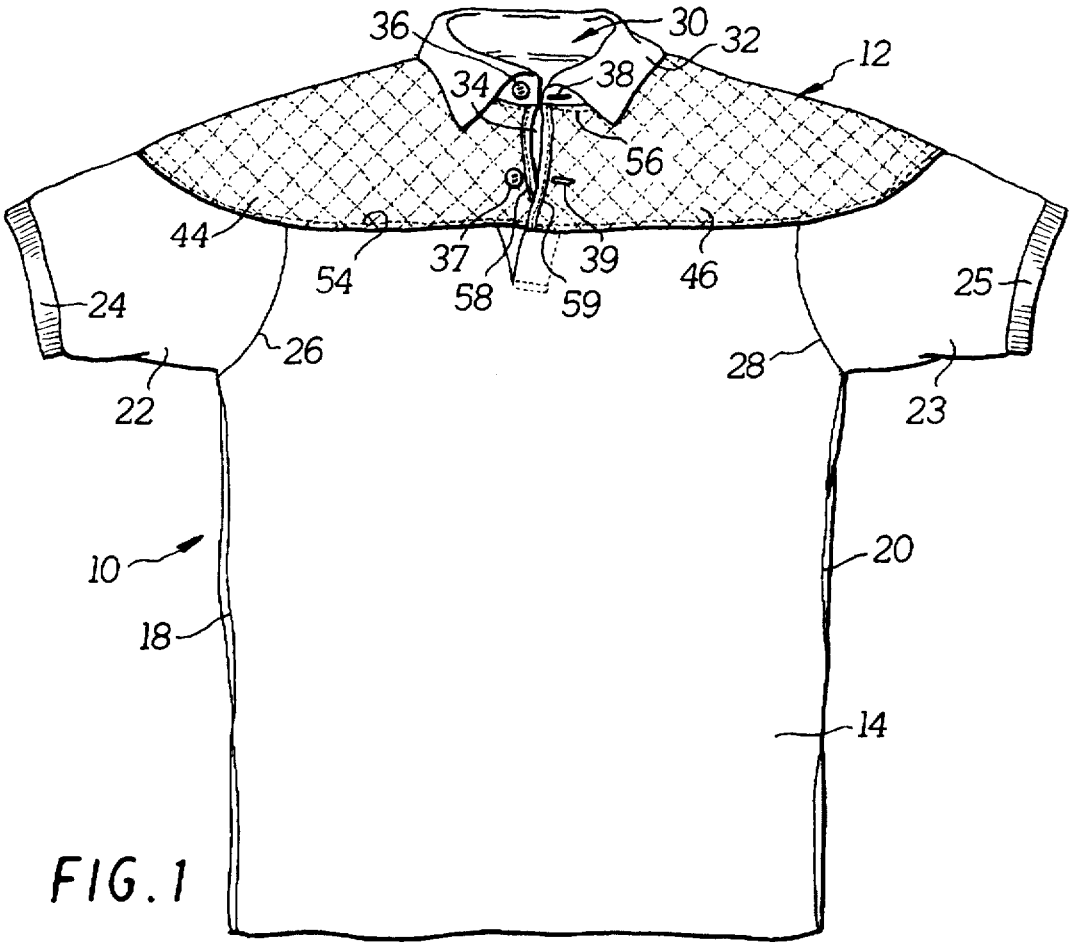
FIG. 1 is a front view of a sport shirt incorporating a load-distributing yoke in accordance with a preferred embodiment of the present invention.

A sport shirt 10 in accordance with the preferred embodiment of the present invention is illustrated in FIGS. 1–4. Although the sport shirt 10 is primarily intended for use by golfers, the invention should not be regarded as being limited to such use since it will become readily apparent that the shirt 10 may be used (with or without modifications) in other environments where loads are applied to the shoulders of the wearer. Examples include hunters, fishermen, photographers, travellers carrying heavy luggage, parents carrying infants and small children in shoulder-supported slings or papooses, musicians carrying instruments in marching bands, and postal delivery workers carrying heavy mail bags. It will also be understood that, although FIGS. 1–4 illustrate the sport shirt 10 as being of the short-sleeve type, the principles of the present invention are also applicable to long-sleeve shirts and to jackets, coats and other types of upper body garments.

With continued reference to FIGS. 1–4, the construction of the shirt 10 is conventional except for the provision of a load-distributing yoke 12, the detailed construction of which will be discussed in detail shortly. Thus, the shirt 10 will be seen to comprise a front torso portion or panel 14 and a rear torso portion or panel 16, which are sewn together along vertical seam lines 18 and 20 at the sides of the shirt. Sleeves 22 and 23 with elastic openings 24 and 25 are attached to the front and rear portions 14 and 16 of the shirt 10 by means of circular seam lines 26 and 28, respectively. The upper portion of the shirt 10 includes a neck opening 30 bordered by a turned-down collar 32, and a vertical slit or opening 34 which can be closed by a pair of buttons 36 and 37 and corresponding buttonholes 38 and 39. The front and rear portions 14 and 16, sleeves 22 and 23 and collar 32 may be made of any desired garment material or materials, although fabrics such as cotton and cotton/polyester blends are preferred. In general, the materials used to make the shirt 10 should be lightweight and should have good moisture evaporative and heat dissipation characteristics.

Figure 2:
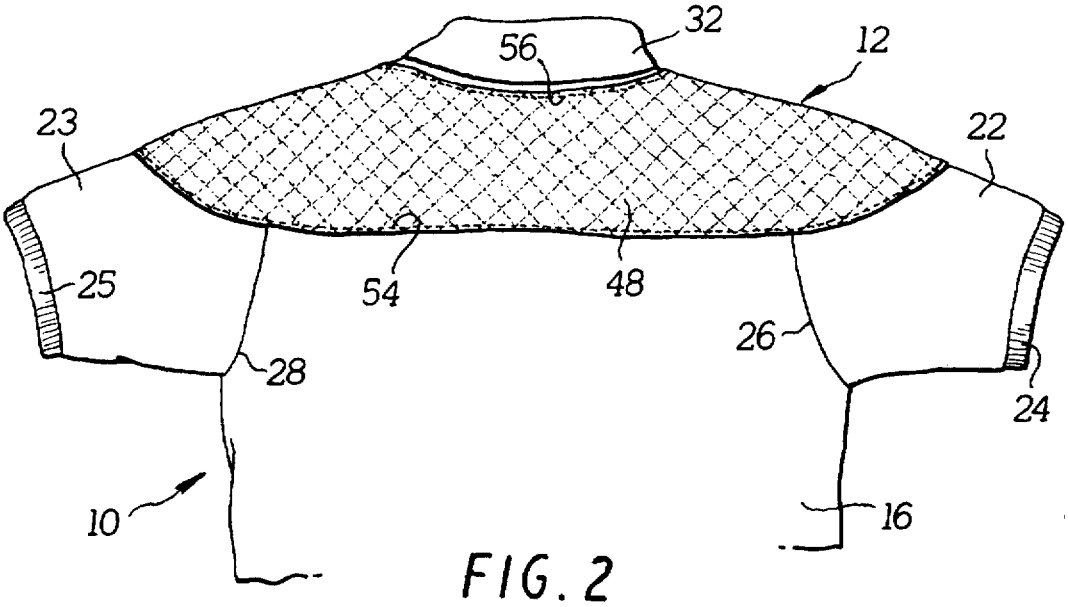
FIG. 2 is a rear view of the sport shirt shown in FIG. 1.

In accordance with the present invention, the conventional shirt construction described above is modified by affixing a load-distributing yoke 12 to the upper regions of the front and rear torso portions 14 and 16 of the shirt 10 and to the upper regions of the sleeves 22 and 24, as shown. Preferably, the yoke 12 extends transversely along the shoulder seam line on each side of the shirt 10 from a point underneath the collar 32, across the seam line 26 or 28 of the respective sleeve 22 or 23, and ending at a point approximately halfway across the top of the sleeve 22 or 23. The yoke 12 also extends downwardly along the front of the shirt from a point just below the top button 36 to a point somewhat above the bottom extent of the vertical opening 34. The yoke 12 extends downwardly along the back of the shirt by an approximately equal distance, as shown in FIG. 2. On the front side of the shirt, the yoke 12 extends inwardly from the sleeves 22 and 23 nearly to the edges of the vertical opening 34, with the lower button 37 being sewn to the yoke 12 and to the underlying portion 14 of the shirt 10 and with the lower buttonhole 39 similarly being formed through both the yoke 12 and the underlying portion 14 of the shirt 10. As a result of this configuration, the yoke 12 extends completely around the neck opening 30 and collar 32 of the shirt without any significant gaps, as shown in the top view of FIG. 3. In the preferred embodiment, the yoke 12 has a generally elliptical shape when viewed from above, with rounded points or apexes lying along the tops of the sleeves 22 and 23.

Figure 3:
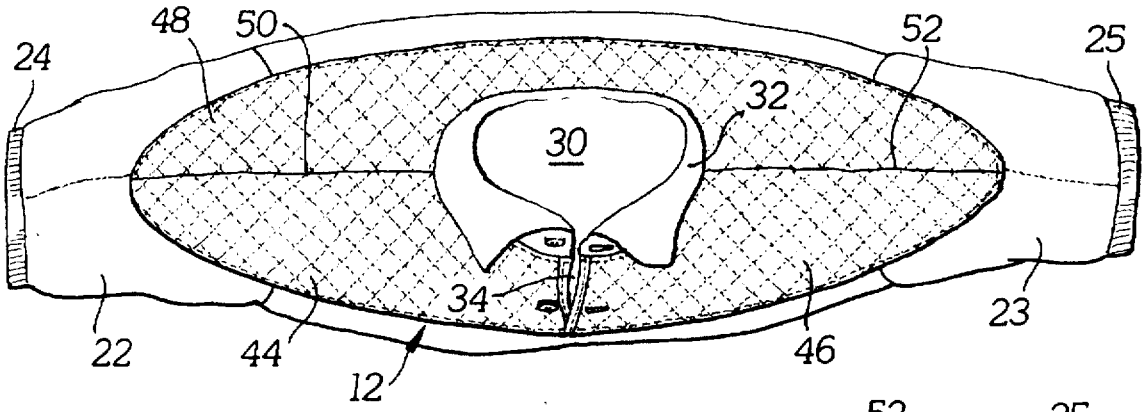
FIG. 3 is a top view of the sport shirt shown in FIG. 1.
Figure 4:
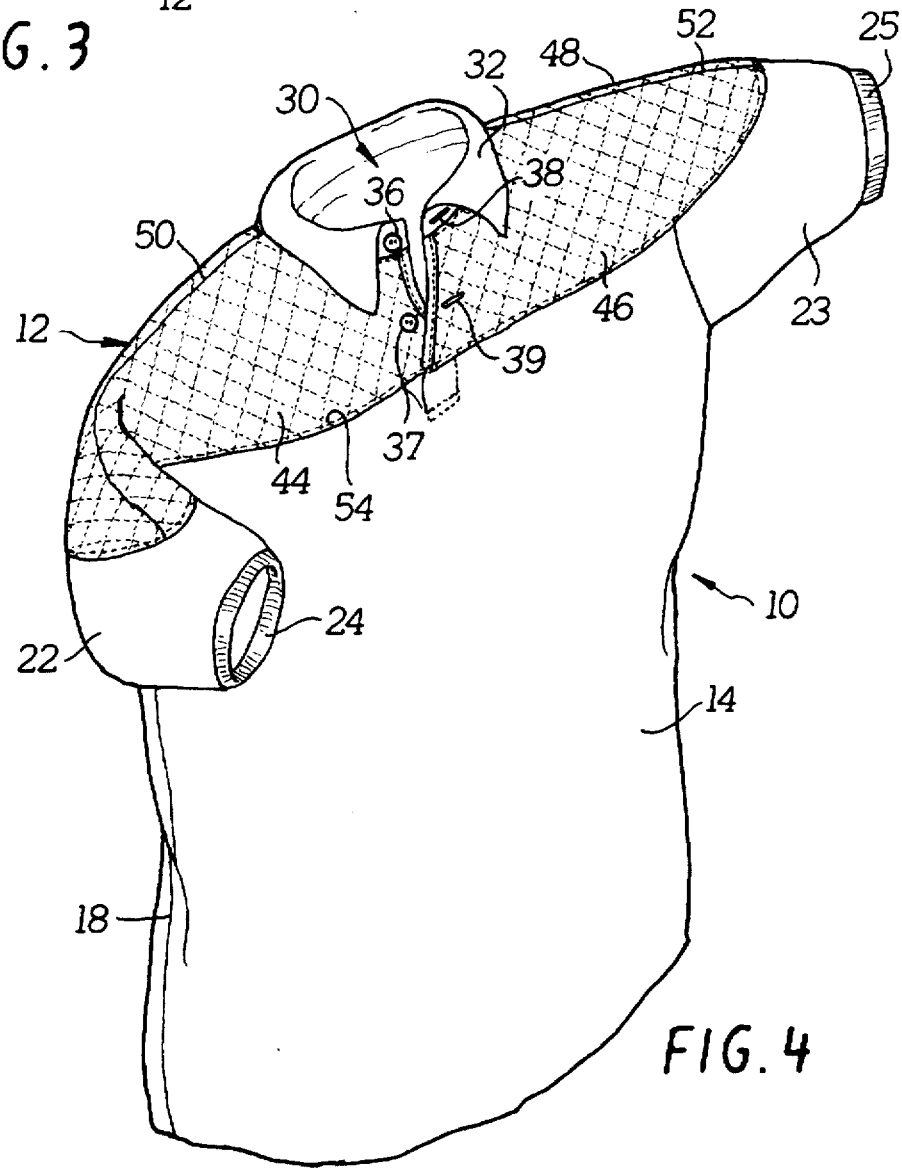
FIG. 4 is a perspective view of the sport shirt shown in FIG. 1.

For ease of fabrication, particularly when the yoke 12 is adapted to an existing type of shirt 10, the yoke 12 may be made in three parts. The first two parts 44 and 46 form the front of the yoke 12 and are located on the left and right sides of the vertical opening 34, as shown in FIGS. 1, 3 and 4. The third portion 48 of the yoke 12 extends in one piece across the back of the shirt 10, as shown in FIGS. 2 and 3. The two front parts 44 and 46 of the yoke 12 are attached to the rear part 48 along seam lines 50 and 52, which extend parallel to the shoulder seam lines of the shirt 10 as illustrated in FIGS. 3 and 4. The yoke 12 as a whole is attached to the shirt 10 by a first line of stitches 54 which extends entirely around the outer periphery of the yoke 12, by a second line of stitches 56 which extends around the collar 32 and neck opening 30, and by two additional lines of stitches 58 and 59 which lie parallel to the vertical opening 34 on either side thereof. Although this three-part construction of the yoke 12 is preferable, it is also possible to fabricate the yoke 12 in a manner such that the portions 44, 46 and 48 form a single piece with no seams or discontinuities, other than the gap necessary to accommodate the vertical opening 34 of the shirt 10. Of course, if the shirt 10 is of the crew-neck type, the gap 34 may be omitted and the yoke 12 may be provided in the form of a continuous elliptical ring without any gaps or breaks.

Figure 5:
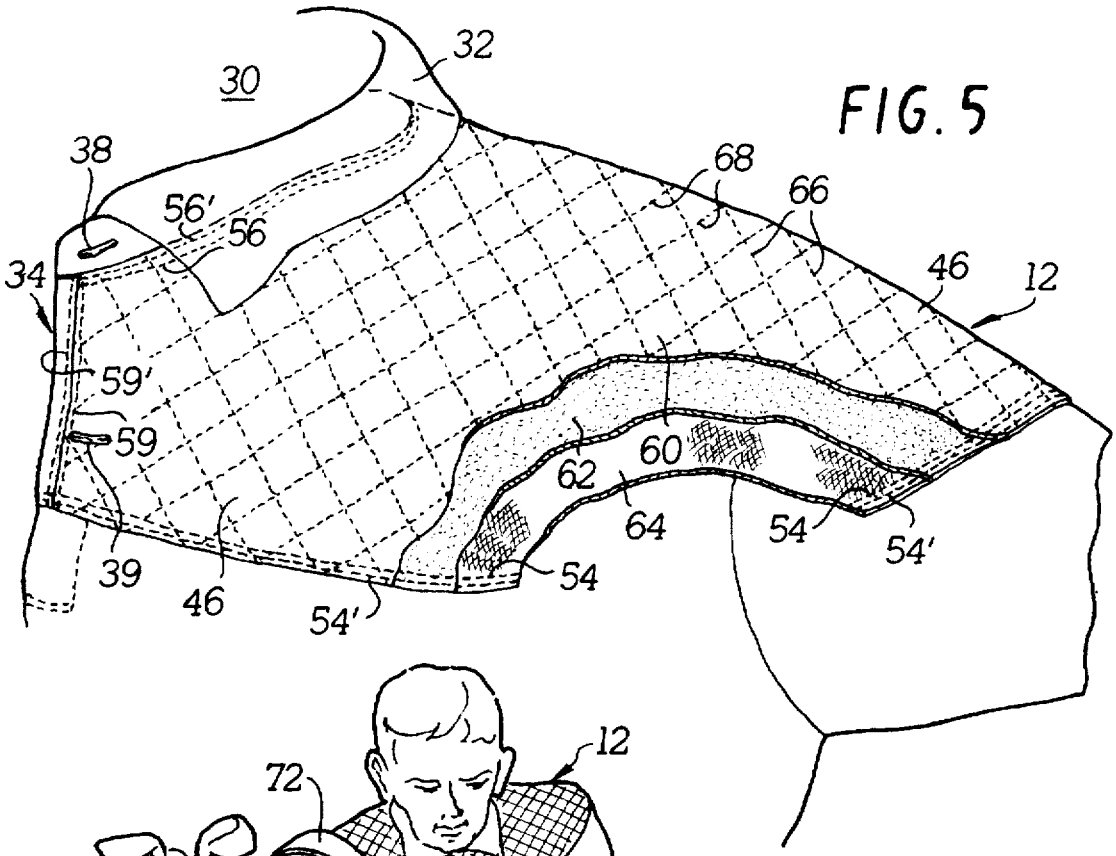
FIG. 5 is a partial cut-away view of the upper right-hand portion of the sport shirt shown in FIG. 1, illustrating the fabric and filler layers which make up the load-distributing yoke.
Figure 6:
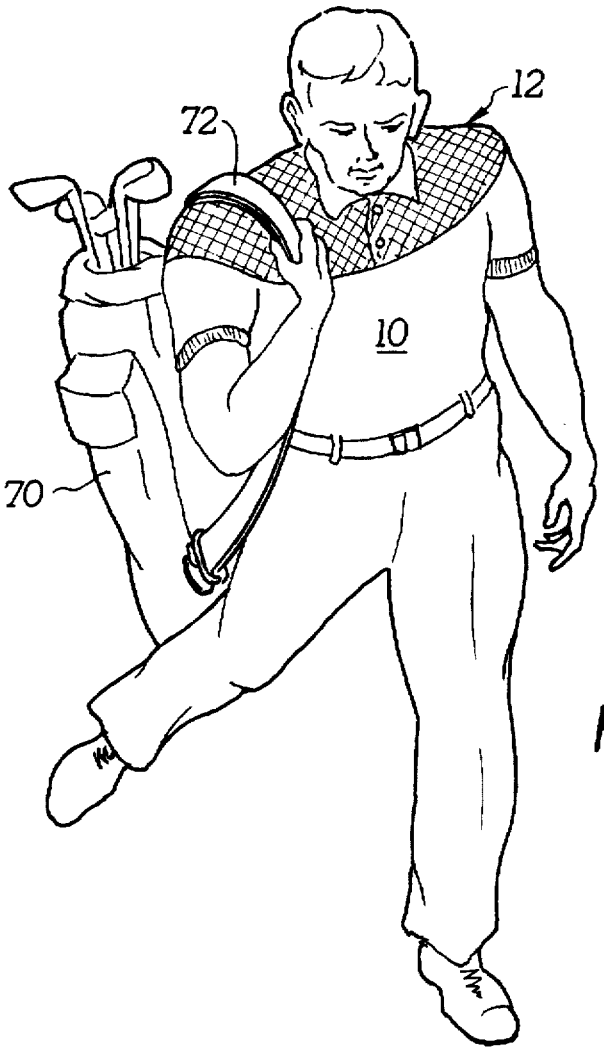
FIG. 6 is a perspective view of a golfer wearing the sport shirt of FIG. 1, illustrating the manner in which the weight of the golf bag strap is cushioned and distributed by the yoke.

FIG. 5 is a cutaway view which illustrates the detailed construction of the yoke 12. In the preferred embodiment, the yoke 12 comprises three separate, overlapping layers which together form a load-distributing laminate or "sandwich". The top or outer layer 60 is preferably made of a lightweight woven fabric, such as cotton or a cotton/polyester blend, with a somewhat finer weave than that of the shirt 10 to provide a relatively smooth surface. Beneath the top layer 60 is an inner layer of filler material 62, approximately one-sixteenth to one-eighth inch in thickness, which provides a padding or cushioning effect and distributes the load applied to the top layer 60 by the strap of a golf bag. Preferred materials for the filler material 62 are polyester, cotton, wool or silk batting or fiberfill materials of the type typically used in quilt construction. Representative examples of these filler materials are produced by the Stearns Technical Textiles Company under the trade names of Mountain Mist® polyester "Fatt Batt", "Blue Ribbon Cotton Batting" and "Fiberloft" fiberfill. Other companies produce batting and fiberfill under their exclusive trade names as well. In addition, examples of other suitable materials include fleeces, napped fabrics and the like which are lightweight and breathable in order to permit the release of body heat and promote the evaporation of perspiration. The filler material 62 may be provided in a single layer as shown, or in multiple overlapping layers if desired. Venting of body heat and moisture can be further enhanced by providing vent holes (not shown) in the layer of filler material 62. Beneath the layer 62 of filler material is a bottom fabric layer 64, which is preferably made of the same material as the outer fabric layer 60. The fabric layer 62 forms the bottom of the yoke 12 and is in contact with the outer surface of the shirt 10 when the yoke 12 is in place on the shirt 10.

As noted previously, the yoke 12 is affixed to the shirt 10 by rows of stitches 54, 56, 58 and 59 which extend parallel to the edges of the yoke 12. Parallel to these lines of stitches are additional lines of stitches (three of which are indicated at 54', 56' and 59' in FIG. 5) which bind the layers 60, 62 and 64 of the yoke 12 to each other. Preferably, the lines of stitches which secure the layers of the yoke 12 to each other are located closer to the edge of the yoke 12 than the lines of stitches which affix the yoke 12 to the shirt 10, as shown. In addition to the stitching lines 54', 56' and 59', a cross-hatched pattern of stitching lines 66 and 68 is formed uniformly across the length and width of the yoke 12 to further bind the layers 60, 62 and 64 together. Preferably, the lines of stitches 66 and 68 extend only through the layers 60, 62 and 64 of the yoke 12 but do not penetrate the underlying material of the shirt 10. In this way, the inside surface of the shirt 10 is kept free of surface irregularities that might otherwise be uncomfortable to the wearer. In the preferred embodiment, the stitching lines 66 are oriented at 90° with respect to the stitching lines 68, so that the resulting cross-hatched pattern is square. In addition, it is preferred that the stitching lines 66 and 68 extend diagonally (preferably at 45°) with respect to the horizontal and vertical dimensions of the shirt 10, as in the illustrated embodiment.

As will be evident from the drawings, the cross-hatched stitching lines 66 and 68 provide the yoke 12 with a quilted appearance. This is not only aesthetically pleasing, but also results in several important advantages. First, the quilting tends to produce air gaps between the respective layers 60, 62 and 64 of the yoke, thereby improving the ability of the yoke 12 thereby to release heat and perspiration. Second, the stitching lines 66 and 68 hold the filler material 62 in place at all points along the length and width of the yoke 12, thereby preventing the filler material 58 from bunching or wrinkling. Finally, the cross-hatched stitching lines 66 and 68 provide the yoke 12 with a slightly ribbed or roughened external surface, which enhances the grip between the yoke 12 and the strap of a golf bag carried by the wearer.

FIG. 10 illustrates the shirt 10 being worn by a golfer carrying a golf bag 70 with a strap 72. As will be apparent, the yoke 12 covers the golfer's shoulders, upper chest and upper back in the area where the strap 72 is likely to fall, thereby cushioning and distributing the weight of the golf bag across a larger area of the golfer's upper torso. At the same time, however, the yoke 12 does not extend into the armpit area below the wearer's arms (i.e., does not cover the lower portions of the seam lines 26 and 28) and hence does not restrict the wearer's arm movements while playing golf. Since the yoke 12 extends symmetrically on both the left and right sides of the shirt 10, the golf bag 70 can be carried on either side and the yoke 12 will still perform its intended function. Even if the strap 72 is oriented crosswise across the user's chest (i.e., from the upper left to the lower right, or vice versa), the yoke 12 will still provide protection since it covers not only the shoulder areas but also the mid-chest area on either side of the vertical opening 34 of the shirt 10. Since the back portion of the yoke 12 is essentially identical to the front portion (except for the absence of the gap needed to accommodate the vertical opening 34), the same protection is afforded to the golfer's upper back.

As an alternative to the construction illustrated in the drawings, the yoke 12 may be fabricated without the bottom fabric layer 64, thereby placing the layer 62 of filler material directly against the outside surface of the shirt 10. This construction is slightly simpler, but results in a somewhat reduced degree of cushioning and load distribution when the strap 72 of a golf bag 70 is placed over the yoke 12. The quilting effect produced by the cross-hatched lines of stitches 66 and 68 may be preserved by stitching only the layers 60 and 62 together, thereby avoiding the need for the stitches to penetrate the upper part of the shirt 10. However, if the nature of the filler material 58 is such that it cannot be effectively stitched to the outer fabric layer 56 (which may be true in the case of some types of non-woven filler materials), it may be necessary for the stitch lines 66 and 68 to penetrate the upper part of the shirt 10.

Although the present invention has been described with reference to a preferred embodiment thereof, it will be understood by those skilled in the art that various substitutions and modifications can be made therein. All such substitutions and modifications are intended to fall within the spirit and scope of the invention as defined in the appended claims.

What is claimed is:

1. A sport shirt or other garment adapted to relieve the strain resulting from carrying a golf bag or the like, comprising front and rear portions for covering the chest and back of the wearer, respectively, a neck opening for accommodating the neck of the wearer, a pair of sleeves for covering at least the upper portions of the arms of the wearer, and a load-distributing yoke affixed to and covering upper regions of said front and rear portions of said garment and upper regions of said sleeves for distributing the weight of a golf bag strap across the shoulders and upper torso of the wearer, said load-distributing yoke extending substantially completely around said neck opening and comprising an outer layer and an inner layer of filler material below said outer layer, said filler material serving to cushion the shoulders and upper torso of the wearer against the weight of said golf bag strap.

2. A sport shirt or other garment as claimed in claim 1, wherein said filler material comprises a breathable, low-density material for venting body heat and evaporating moisture.

3. A sport shirt or other garment as claimed in claim 1, wherein each of said sleeves is attached to the front and rear portions of said garment by a seam line, and wherein said load-distributing yoke covers an upper portion of said seam line but does not cover a lower portion of said seam line located below the arm of the wearer, thereby allowing the wearer's arm to move in a substantially unrestricted manner.

4. A sport shirt or other garment as claimed in claim 1, further comprising a vertical opening in said front portion of said garment communicating with said neck opening, and wherein said load-distributing yoke has a corresponding gap aligning with said vertical opening.

5. A sport shirt or other garment as claimed in claim 1, wherein said load-distributing yoke is affixed to the upper regions of said front and rear portions of said garment and to the upper regions of said sleeves by lines of stitching emending substantially completely around peripheral edges of said yoke and passing through the outer and inner layers of said yoke.

6. A sport shirt or other garment as claimed in claim 1, wherein the outer and inner layers of said load-distributing yoke are secured to each other by cross-hatched lines of stitching forming a quilted pattern in said yoke.

7. A sport shirt or other garment as claimed in claim 6, wherein said cross-hatched lines of stitching extend diagonally with respect to vertical and horizontal dimensions of said garment.

8. A sport shirt or other garment as claimed in claim 6, wherein said load-distributing yoke further comprises a bottom layer below said inner layer of filler material, and wherein said cross-hatched lines of stitching extend through said outer, inner and bottom layers of said yoke but do not penetrate the front and rear portions and sleeves of said garment.

9. A sport shirt or other garment as claimed in claim 1, wherein said load-distributing yoke further comprises a bottom layer below said inner layer of filler material.

10. A sport shirt or other garment as claimed in claim 1, wherein said load-distributing yoke has a symmetrical shape with respect to left and right sides of the garment in order to allow the wearer to carry a golf bag on either of the wearer's shoulders.

11. A sport shirt or other sleeved garment adapted to relieve the strain resulting from carrying a golf bag or the like, comprising front and rear portions for covering the chest and back of the wearer, respectively, a neck opening for accommodating the neck of the wearer, a pair of sleeves for covering at least the upper portions of the arms of the wearer, and a load-distributing yoke affixed to and covering upper regions of said front and rear portions of said garment and upper regions of said sleeves for distributing the weight of a golf bag strap across the shoulders and upper torso of the wearer, said load-distributing yoke comprising an outer layer an inner layer of filler material below said outer layer for cushioning the shoulders and upper torso of the wearer against the weight of a golf bag strap, and a bottom layer below said inner layer of filler material, said bottom layer overlying said upper regions of said front and rear portions of said garment and said upper regions of said sleeves.

12. A sport shirt or other garment as claimed in claim 11, wherein said filler material comprises a breathable, low-density material for venting body heat and evaporating moisture.

13. A sport shirt or other garment as claimed in claim 11, wherein said outer inner and bottom layers are shaped and dimensioned to cover upper portions of seam lines by which said sleeves are attached to said garment, but not to cover lower portions of said seam lines located below the arms of the wearer, thereby allowing the wearer's arms to move in a substantially unrestricted manner.

14. A sport shirt or other garment as claimed in claim 11, wherein said outer inner and bottom layers are formed with a gap to align with a vertical opening in the front portion of said garment.

15. A sport shirt or other garment as claimed in claim 11, wherein the outer inner and bottom layers of said load-distributing yoke are secured to each other by cross-hatched lines of stitching forming a quilted pattern in said yoke.

16. A sport shirt or other garment as claimed in claim 15, wherein said cross-hatched lines of stitching are oriented so as to extend diagonally with respect to vertical and horizontal dimensions of said garment.

17. A sort shirt or other garment as claimed in claim 11, wherein said outer and bottom layers of said load-distributing yoke are made of fabric.

18. A sport shirt or other garment as claimed in claim 11, wherein said load-distributing yoke has a symmetrical shape with respect to left and right sides of the garment in order to allow the wearer to carry a golf bag on either of the wearer's shoulders.

19. A sport shirt or other garment adapted to relieve the strain resulting from carrying a golf bag or the like, comprising from and rear portions for covering the chest and back of the wearer, respectively, a neck opening for accommodating the neck of the wearer, a pair of sleeves for covering at least the upper portions of the arms of the wearer, and a load-distributing yoke affixed to and covering upper regions of said front and rear portions of said garment and upper regions of said sleeves for distributing the weight of a golf bag strap across the shoulders and upper torso of the wearer, said load distributing yoke comprising an outer layer, an inner layer of filler material below said outer layer, and a bottom layer below said inner layer of filler material, said outer, inner and bottom layers of said load distributing yoke being secured to each other by cross-hatched lines of stitching forming a quilted pattern in said yoke, said cross-hatched lines of stitching extending through said outer, inner and bottom layers of said yoke but not penetrating the front and rear portions and sleeves of said garment.

20. A sport shirt or other garment as claimed in claim 19, wherein said filler material comprises a breathable, low-density material for venting body heat and evaporating moisture.

* * * * *